US006195906B1

(12) United States Patent
Stoll

(10) Patent No.: US 6,195,906 B1
(45) Date of Patent: Mar. 6, 2001

(54) AIR PURIFICATION SYSTEM AND FOOD DEHYDRATION UNIT

(76) Inventor: Fedna Stoll, Scabiosastraat 4, P.O. Box 9482, Paramaribo, Suriname (SR)

( * ) Notice: Subject to any disclaimer, the term of this patent is extended or adjusted under 35 U.S.C. 154(b) by 0 days.

(21) Appl. No.: 09/420,028

(22) Filed: Oct. 18, 1999

(51) Int. Cl.[7] ..... F26B 15/00
(52) U.S. Cl. ..... 34/80
(58) Field of Search ..... 34/80, 202, 210, 34/218; 55/385.1; 96/322, 361

(56) References Cited

U.S. PATENT DOCUMENTS 3,633,340 * 1/1972 Illingworth ..... 55/84
4,556,043 * 12/1985 Bratton ..... 126/21 A
5,762,665 * 6/1998 Abrahamian et al. ..... 55/385.3
5,987,773 * 11/1999 Lipsey ..... 34/106

* cited by examiner

*Primary Examiner*—Corrine McDermott
*Assistant Examiner*—Malik N. Drake
(74) *Attorney, Agent, or Firm*—Michael I. Kroll

(57) ABSTRACT

An air-injected dehydration apparatus for dehydrating a food product. The apparatus includes a dehydration chamber having a plurality of controllable heating elements extending therethrough and a device for moving the food product within the chamber. An air injection system providing air to the chamber and an exhaust is provided for exhausting air from the chamber. The air injection system includes an air compressor for supplying pressurized air to the chamber, a pressure conduit to channel the pressurized air from the compressor to the chamber and a device for dispersing the air within the chamber. The air provided to the chamber should preferably be sterilized by a decontamination system. The decontamination system includes an air intake assembly for supplying a flow of air and an air purification chamber comprising an air inlet functionally connected to the air intake assembly, a device for purifying the air as it passes through said chamber, and an air outlet. The air purification chamber includes a nozzle positioned on a top side thereof for spraying a purifying substance in a constant curtain across the chamber in a direction transverse to the flow of air therethrough to remove contaminants from the air flowing below the nozzle. A filter is provided at the inlet to the chamber and a decontamination tank is positioned below the nozzle for receiving the purifying substance and contaminants sprayed by the nozzle. The contaminants are removed from the purifying substance and returned to the nozzle for spraying therethrough.

31 Claims, 16 Drawing Sheets

AIR PURIFICATION SYSTEM AND FOOD DEHYDRATION UNIT

BACKGROUND OF THE INVENTION

1. Field of the Invention

The present invention relates generally to food dehydrators and, more specifically, to a food dehydrating facility utilizing temperature controlled purified wind currents to produce dehydrated food products which retain their natural nutrients and coloring.

2. Description of the Prior Art

Numerous types of dehydrators have been provided in the prior art. While these units may be suitable for the particular purpose to which they address, they would not be as suitable for the purposes of the present invention as heretofore described.

SUMMARY OF THE PRESENT INVENTION

The present invention relates generally to food dehydrators and, more specifically, to a food dehydrating facility utilizing temperature controlled purified wind currents to produce dehydrated food products which retain their natural nutrients and coloring.

A primary object of the present invention is to provide a food dehydrator that will overcome the shortcomings of prior art devices.

It is, therefore, an object of the present invention to provide a method for dehydrating a food product which is able to retain the natural nutrients and coloring of the food product.

Another object of the present invention is to provide a food dehydration facility able to dehydrate food using specific combinations of air and heat whereby the food will maintain its nutritional value.

A further object of the present invention to provide a food dehydration facility able to dehydrate food while maintaining the original color of the food without the use of artificial colorings.

A still further object of the present invention to provide a food dehydration facility able to dehydrate food to produce a dehydrated food product that may be readily reconstituted.

A yet further object of the present invention to provide a food dehydration facility able to produce dehydrated food in a safe, effective manner wherein large quantities of foodstuffs may be treated in a relatively short period of time.

Another object of the present invention is to provide a food dehydration facility that is simple and easy to use.

A still further object of the present invention is to provide a food dehydration facility able to produce dehydrated food products in an economical manner.

Additional objects of the present invention will appear as the description proceeds.

An air-injected dehydration apparatus for dehydrating a food product is disclosed by the present invention. The apparatus includes a dehydration chamber having a plurality of controllable heating elements extending therethrough and a device for moving the food product within the chamber. An air injection system providing air to the chamber and an exhaust is provided for exhausting air from the chamber. The air injection system includes an air compressor for supplying pressurized air to the chamber, a pressure conduit to channel the pressurized air from the compressor to the chamber and a device for dispersing the air within the chamber. The air provided to the chamber should preferably be sterilized by a decontamination system. The decontamination system includes an air intake assembly for supplying a flow of air and an air purification chamber comprising an air inlet functionally connected to the air intake assembly, a device for purifying the air as it passes through said chamber, and an air outlet. The air purification chamber includes a nozzle positioned on a top side thereof for spraying a purifying substance in a constant curtain across the chamber in a direction transverse to the flow of air therethrough to remove contaminants from the air flowing below the nozzle. A filter is provided at the inlet to the chamber and a decontamination tank is positioned below the nozzle for receiving the purifying substance and contaminants sprayed by the nozzle. The contaminants are removed from the purifying substance and returned to the nozzle for spraying therethrough.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction which are illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
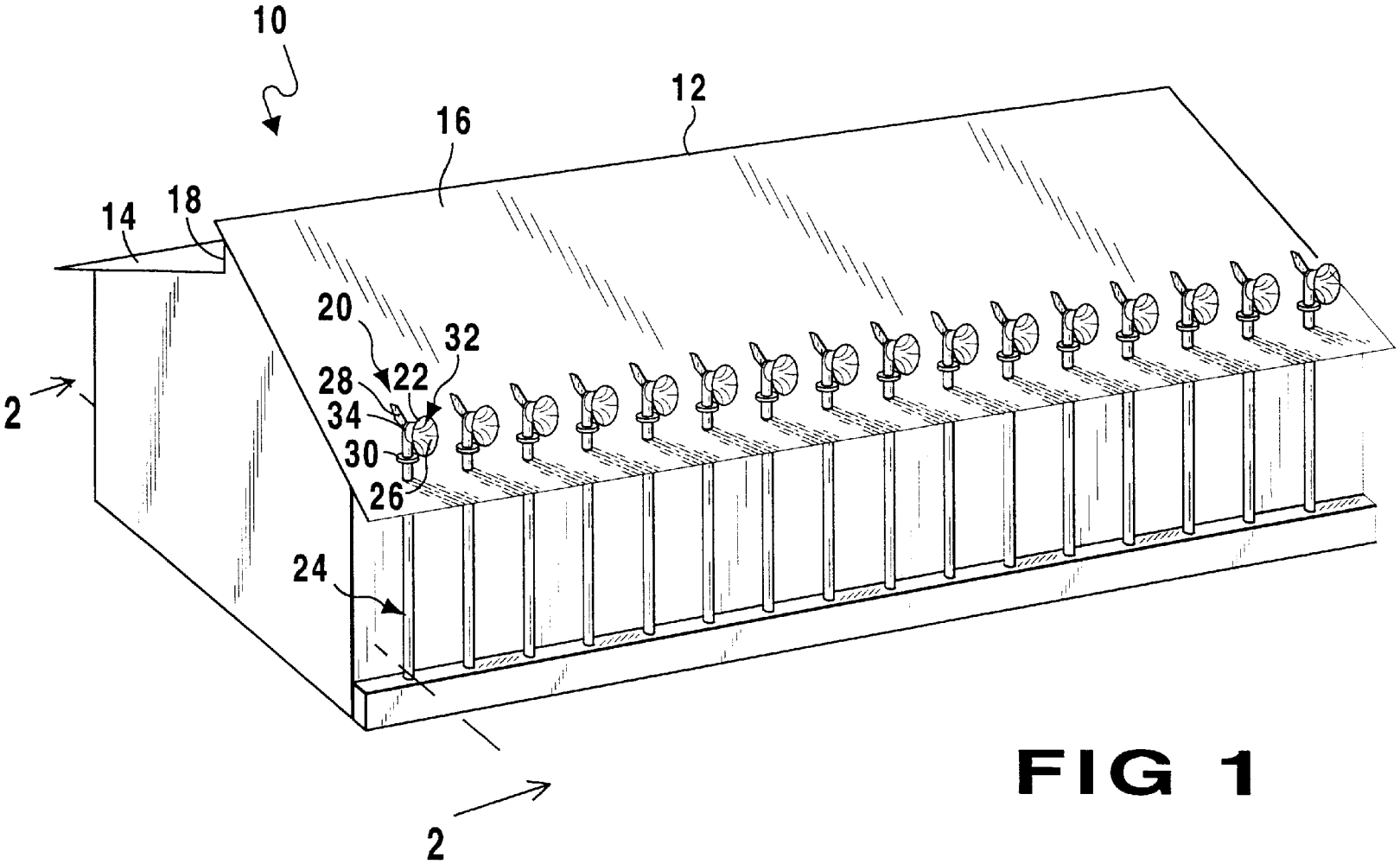
FIG. 1 is a perspective view of the food dehydration facility of the present invention.

Turning now descriptively to the drawings, in which similar reference characters denote similar elements throughout the several views, the Figures illustrate the food dehydration facility of the present invention. With regard to the reference numerals used, the following numbering is used throughout the various drawing figures.

10 food dehydration facility of the present invention
12 structure housing facility
14 lower back roof portion
16 front upper roof portion
18 ventilation wall
20 air receiving device
22 air intake port
24 air conduit
25 wind propelled air intake fan
26 air intake funnel
27 electrical air entraining fan
28 wind vane
30 rotational joint
32 enlarged open side of air intake funnel
34 closed end of air intake funnel
36 hermetically sealed dehydration area
38 storage area
40 wall dividing storage area from hermetically sealed dehydration area
42 arrow indicating rotation of air intake port
44 arrow indicating air flowing into air intake funnel
46 decontamination chamber
48 air inlet
50 solid air filter
52 spray nozzle
54 water spray
56 contaminated water
58 pool
60 air outlet
62 arrows indicating air exiting decontamination chamber
64 air injection dehydration unit
66 plurality of chambers
68 cylinder formed by plurality of chambers
70 conveyor belt
72 recess in side wall chamber at end of cylinder
74 side wall of chamber at end of cylinder
76 air compressor
78 air conduit
80 plurality of air injectors
82 valve on each of plurality of air injectors
84 plurality of first exhaust ducts
86 plurality of connector pipes
88 main exhaust duct
90 second exhaust duct
92 first arm of injector inlet channel
94 second arm of injector inlet channel
96 plurality of air injectors
98 heating elements
100 wall separating adjacent chambers
102 door in wall separating adjacent chambers
104 recess in each chamber providing passage for air out of chamber
106 second embodiment of dehydration chamber
108 cylindrical chamber
110 front wall of cylindrical chamber
112 back wall of cylindrical chamber
114 recess in front wall of cylindrical chamber
116 recess in back wall of cylindrical chamber
118 air inlet pipe
120 bearings connecting air inlet pipe to cylindrical chamber
122 rotary driver motor and guide
124 heating elements
126 mixing arms
128 open end of mixing arms
130 air inlet for exhaust pipe
132 air outlet

DETAILED DESCRIPTION OF THE PREFERRED EMBODIMENTS

Turning now descriptively to the drawings, in which similar reference characters denote similar elements throughout the several views, FIGS. 1 through 16 illustrate the food dehydration facility of the present invention indicated generally by the numeral 10.

The perspective view of the outside of the food dehydration facility 10 is shown in FIG. 1 as a structure 12 having a back roof portion 14 and a front roof portion 16. The back roof portion 14 is positioned at a height below and separated from the front roof portion 16. A ventilation wall 18 extends between the back roof portion 14 and the front roof portion 16.

A plurality of air receiving devices 20 extend along a wall of the structure 12 and through the front roof portion 16. Each of the air receiving devices 20 includes an air intake port 22 and an air conduit 24. The air intake port 22 is positioned atop the front roof portion 16 and includes an intake funnel 26, a wind vane 28 and a rotational joint 30. The air intake funnel 26 includes an enlarged open side 32 for receiving air therein and a closed end 34. The wind vane 28 extends from the closed end 34 facing in a direction opposite the enlarged open side 32. When wind blows against the wind vane 28, the rotational joint 30 allows the air intake funnel 26 to turn with the wind vane 28 until the wind vane 28 extends parallel to the direction of the wind and the air intake funnel 26 faces the wind. The rotational joint 30 connects the air receiving device 20 to the air conduit 24 and allows the air intake port 22 to rotate throughout 360° thus allowing the air intake funnel 26 to face in any direction. This allows the air receiving device 20 to receive a maximum amount of air. The air received by the air intake funnel 26 is provided to the air conduit 24 for delivery to the inside of the structure 12.

Figure 4:
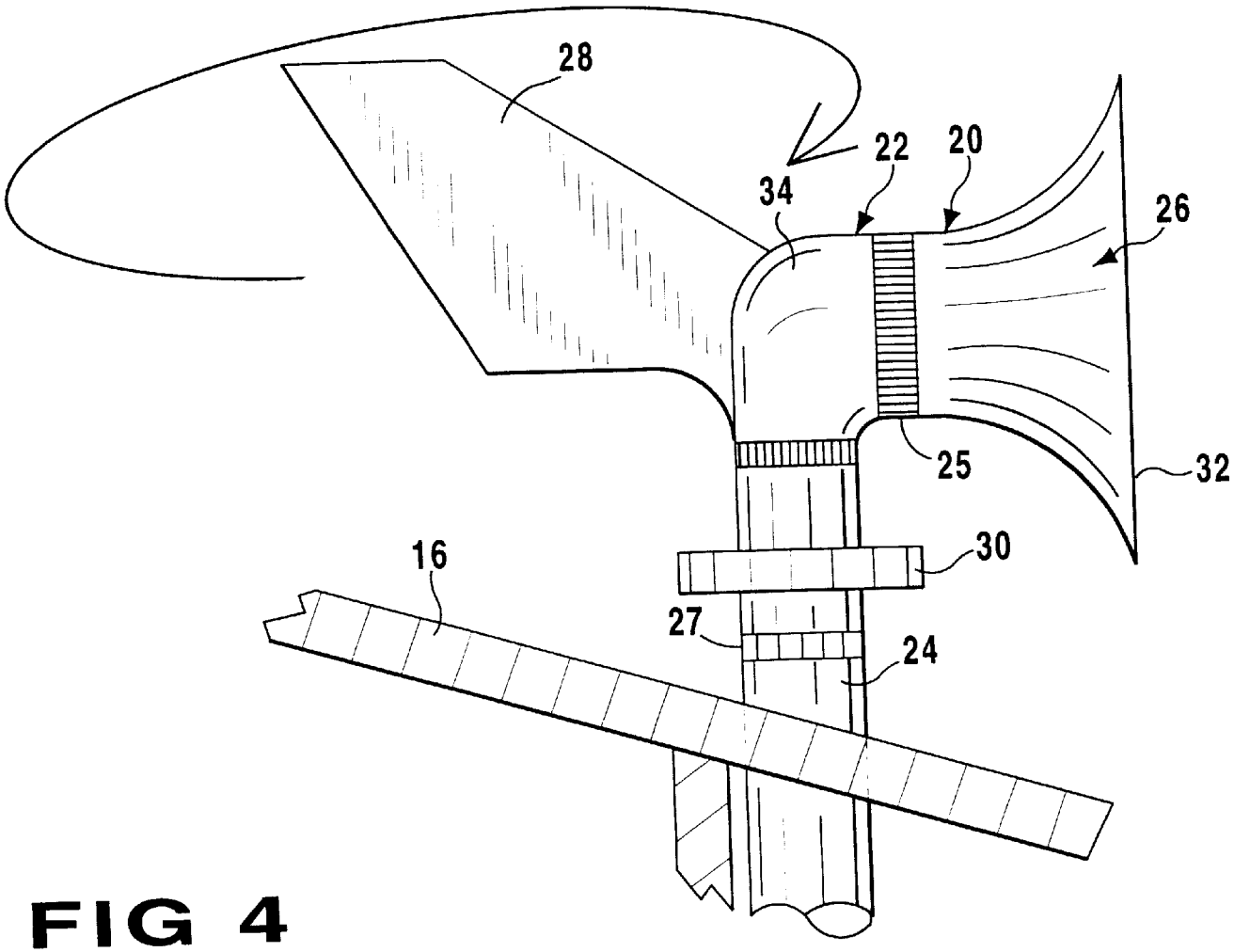
FIG. 4 is an enlarged view of the air intake funnel assembly of the food dehydration facility of the present invention taken from within the circle labeled 4 of FIG. 2.

An enlarged view of the air receiving device 20 is illustrated in FIG. 4. As can be seen from this view, a wind propelled air intake fan 25 is provided at the air intake funnel 26 for aiding in drawing air into the funnel 26. An electrical air entraining fan 27 is also provided in the air conduit 24 below the rotational joint 30 for drawing the air received by the funnel 26 down the air conduit 24.

Figure 2:
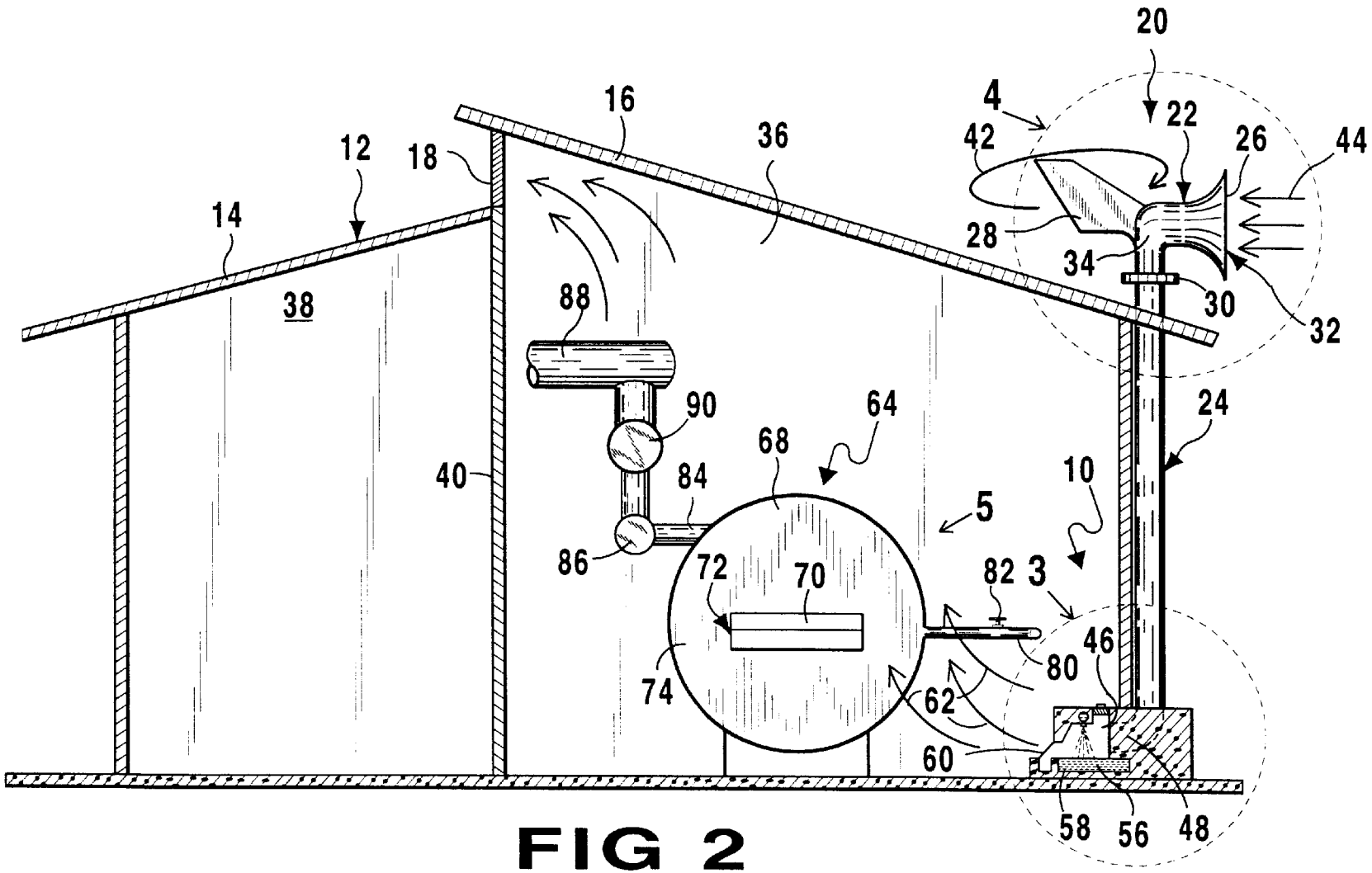
FIG. 2 is a cross-sectional view of the food dehydration facility of the present invention taken along the line 2—2 of FIG. 1.
Figure 3:
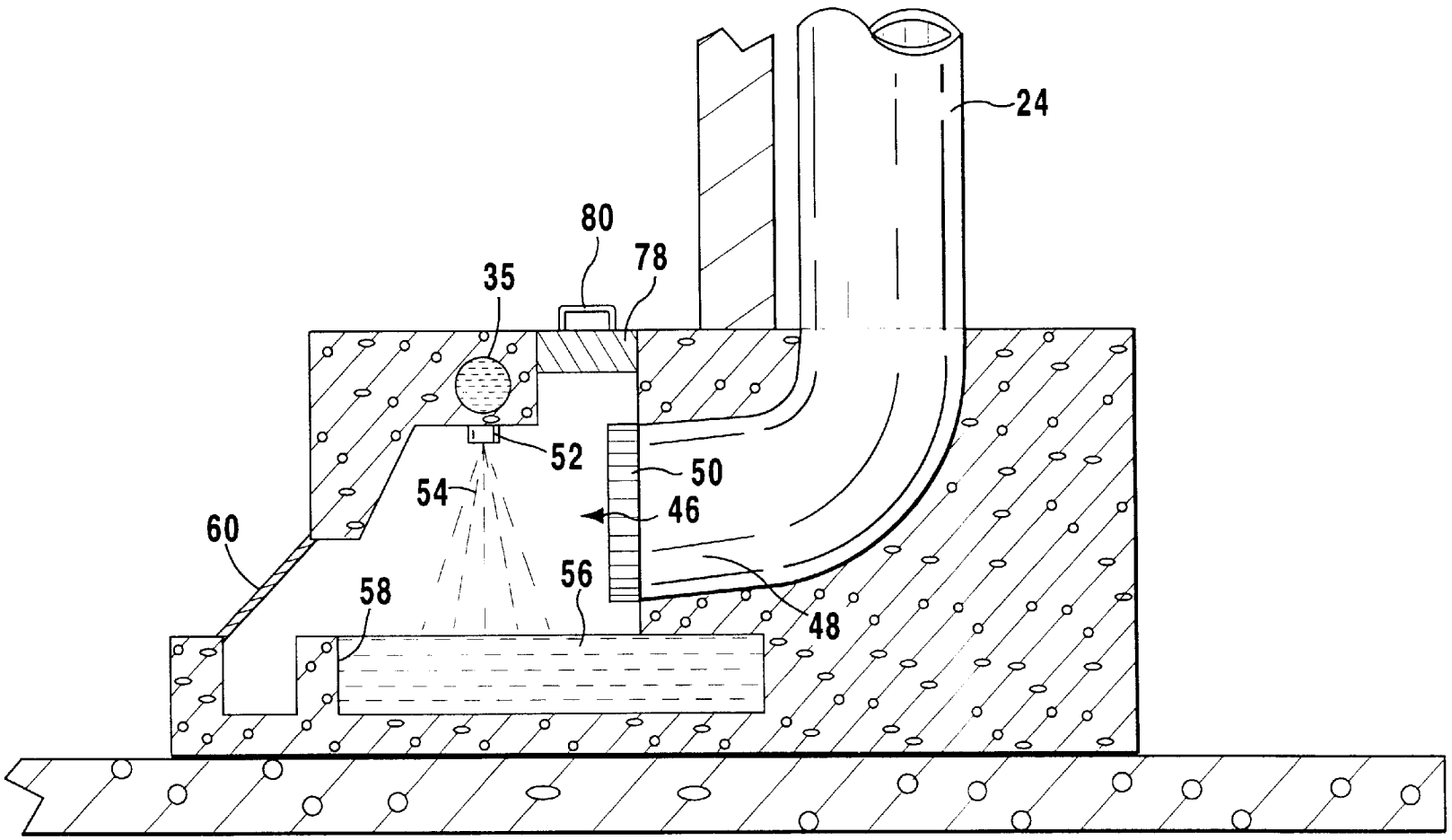
FIG. 3 is an exploded view of the decontamination chamber of the food dehydration facility of the present invention taken from within the circle labeled 3 of FIG. 2.

A cross-sectional view of the structure 12 is illustrated in FIG. 2 showing the elements housed within the structure 12. As can be seen from this figure, the structure 12 is divided into a dehydration area 36 and a storage area 38 by a dividing wall 40. The dehydration area 36 is hermetically sealed and is the portion of the structure 12 in which the food products are dehydrated. Food products which have been dehydrated can be stored in the storage area 38. The dividing wall 40 extends from a floor to the back roof portion 14. Positioned between the top of the dividing wall 40 and the front roof portion 16 is the ventilation wall 18 which ventilates the dehydration area 36 allowing air to exit therefrom.

The air receiving device 20 extends along a side wall of the structure 12 and through the front roof portion 16. The air receiving device 20 includes the air intake port 22 and the air conduit 24. The rotational joint 30 connecting the air receiving port 22 and the air conduit 24 allows the air intake port 22 to rotate about a top end of the air conduit 24 as indicated by the arrow labeled with the numeral 42. A force applied by blowing wind to the wind vane 28 causes the air intake port 22 to rotate to a point at which the wind vane 28 extends in a direction parallel to the blowing wind. In this position the air intake funnel 26 faces into the wind indicated by the numeral 44 and thus is able to receive a maximum amount of air. The air conduit 24 of the air receiving device 20 extends through a side wall of the structure 12 and into the dehydration area 36. The air conduit 24 connects to a decontamination chamber 46 positioned within the dehydration area 36. An enlarged view of the decontamination chamber 46 can be seen from FIG. 3.

Positioned at an inlet 48 to the decontamination chamber 46 is an air filter 50. The air filter 50 is preferably an air-permeable particle-extraction filter and provides a first filtration and purification of the air entering the dehydration area 36. Once the air passes through the air filter 50 it enters the decontamination chamber 46 and passes under a spray nozzle 52. The spray nozzle 52 sprays a purifying substance 54, preferably water, downward across the width of the decontamination chamber 24 forming a steady curtain running in a direction transverse to the flow of air through the chamber 24. Contaminants are removed from the air as it passes through the spray 54 and are retained by the water. The contaminated water 56 is received by a pool 58 formed in a base of the chamber 24. The contaminated water 56 within the pool 58 is sanitized and recycled back to the spray nozzle 52. The contaminated water 56 may be sanitized by any one or a combination of an ultraviolet light, an ozonator, and a media filter (e.g. sand, a cartridge, diatomaceous earth, etc.). After passing through the purification spray 54, the sanitized air flows through an air outlet 60 and into the dehydration area 36 as indicated by the arrows labeled with the numeral 62.

Figure 5:
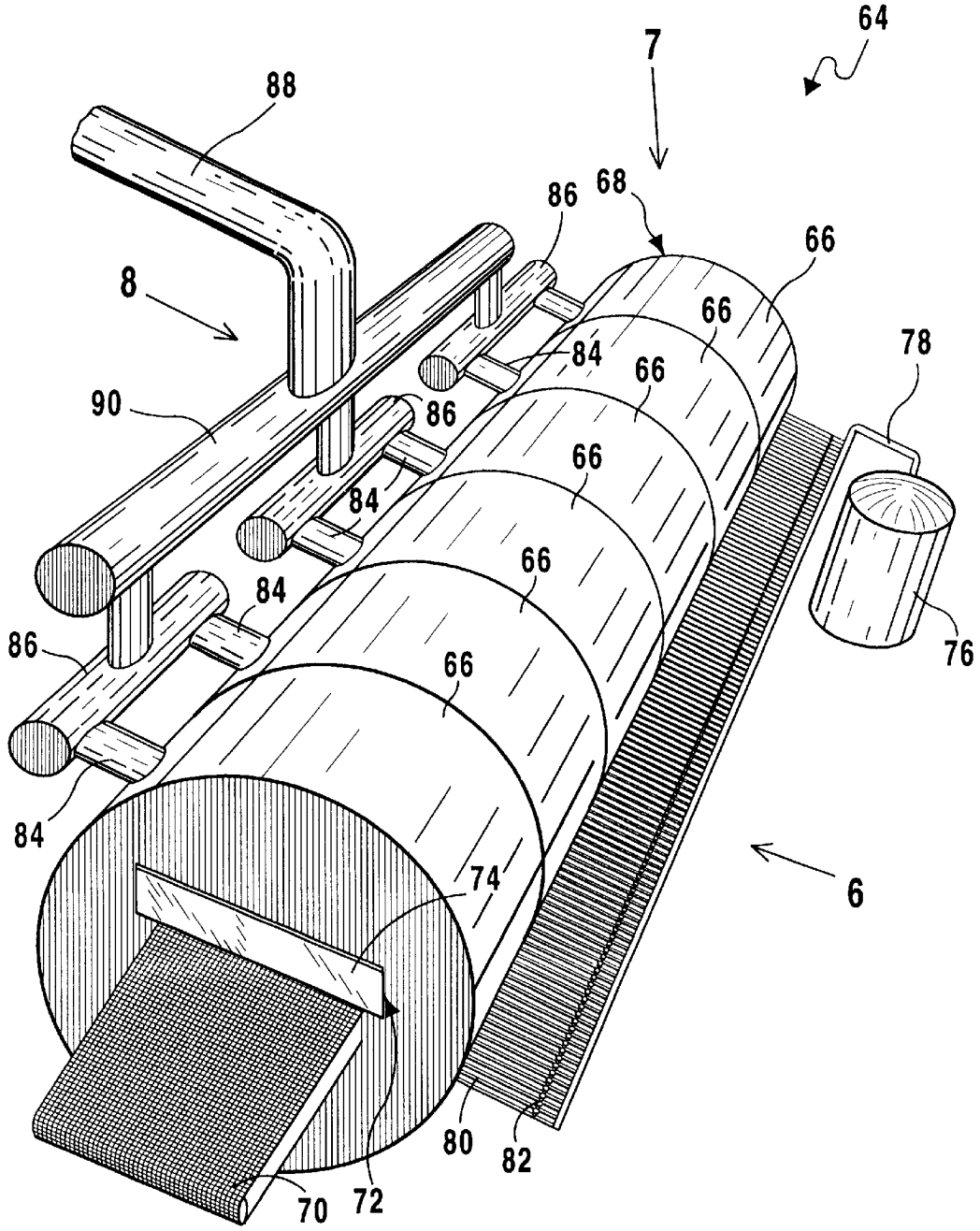
FIG. 5 is a perspective view of the dehydration unit within the food dehydration facility of the present invention taken in the direction of the arrow labeled 5 of FIG. 2.
Figure 6:
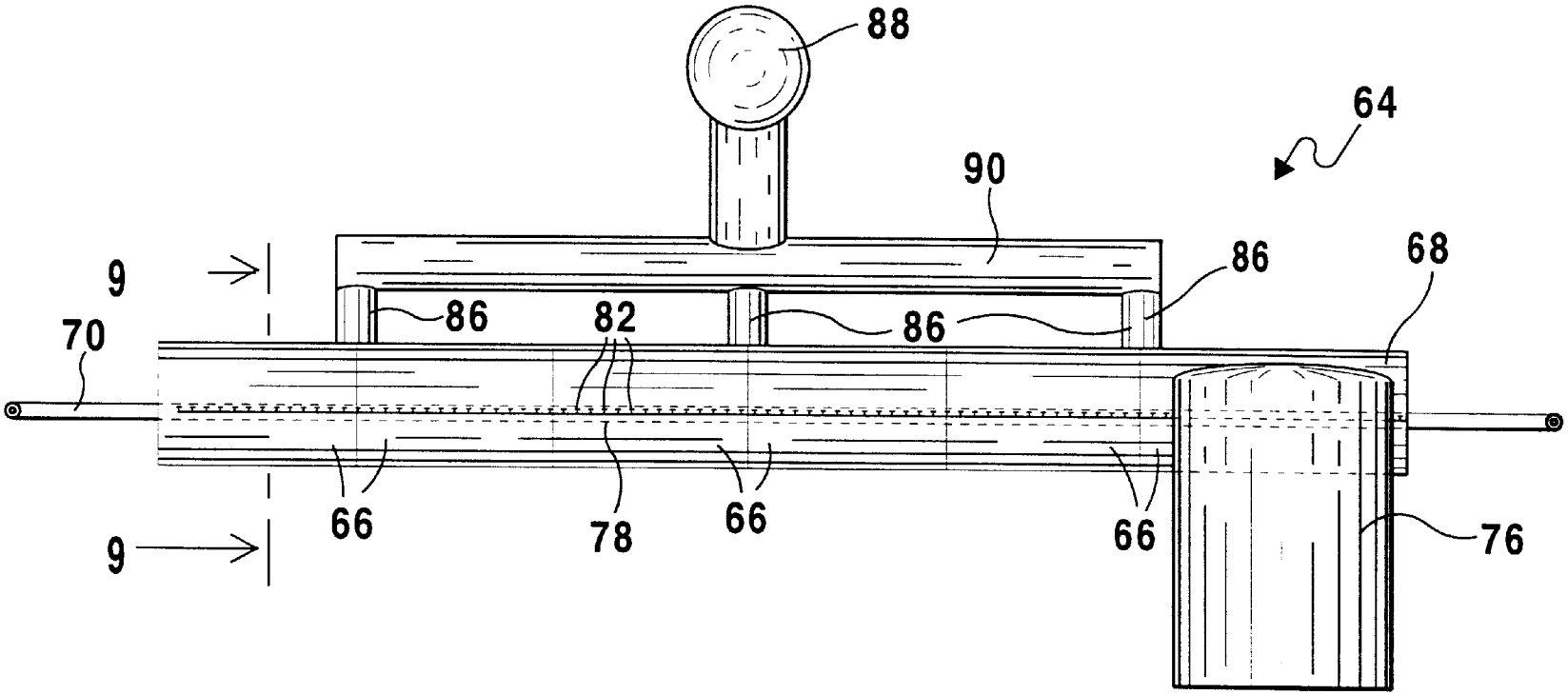
FIG. 6 is a front view of the dehydration unit within the food dehydration facility of the present invention.
Figure 7:
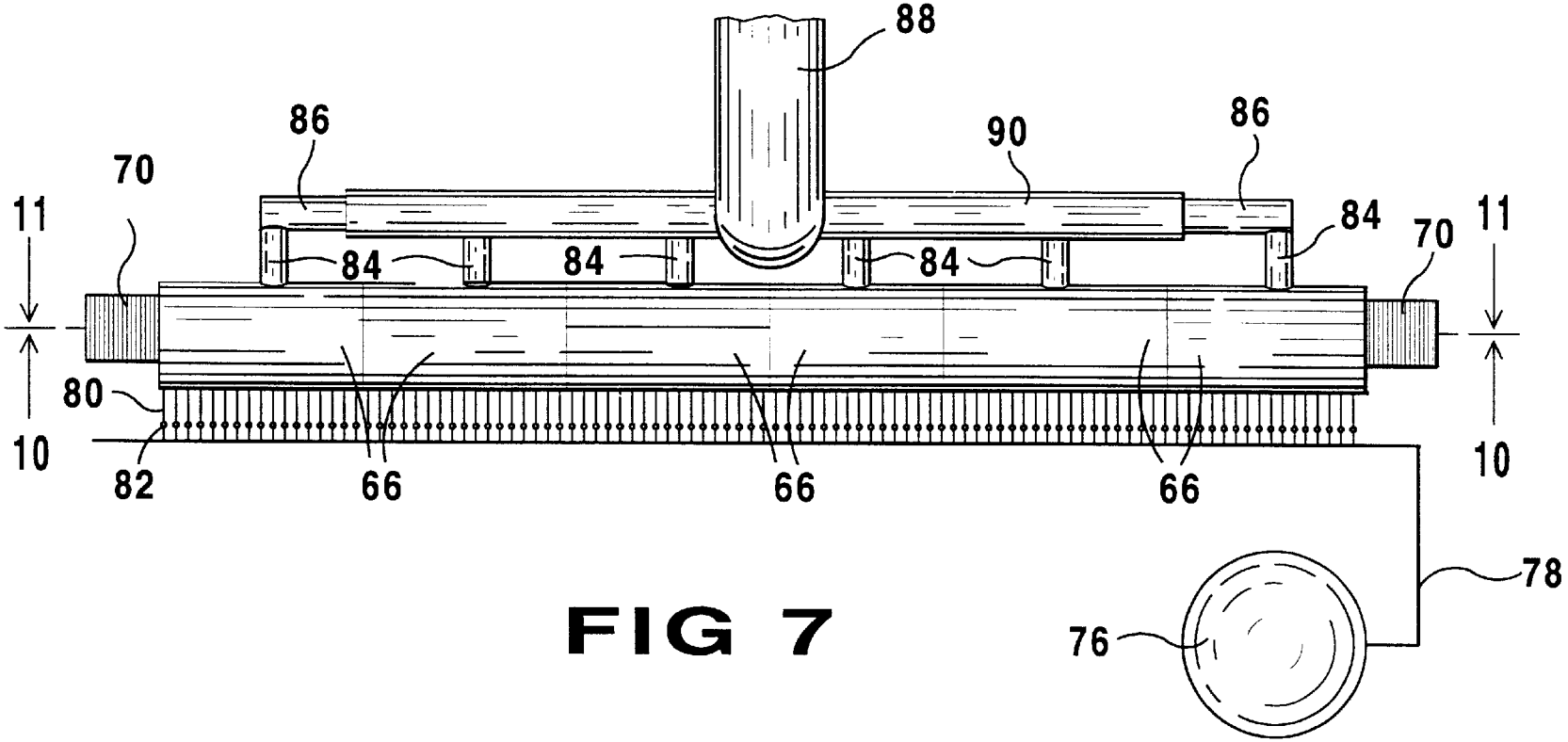
FIG. 7 is a top plan view of the dehydration unit within the food dehydration facility of the present invention illustrating the general configuration of the exhaust ducts where each individual chamber empties into a common exhaust vent.
Figure 8:
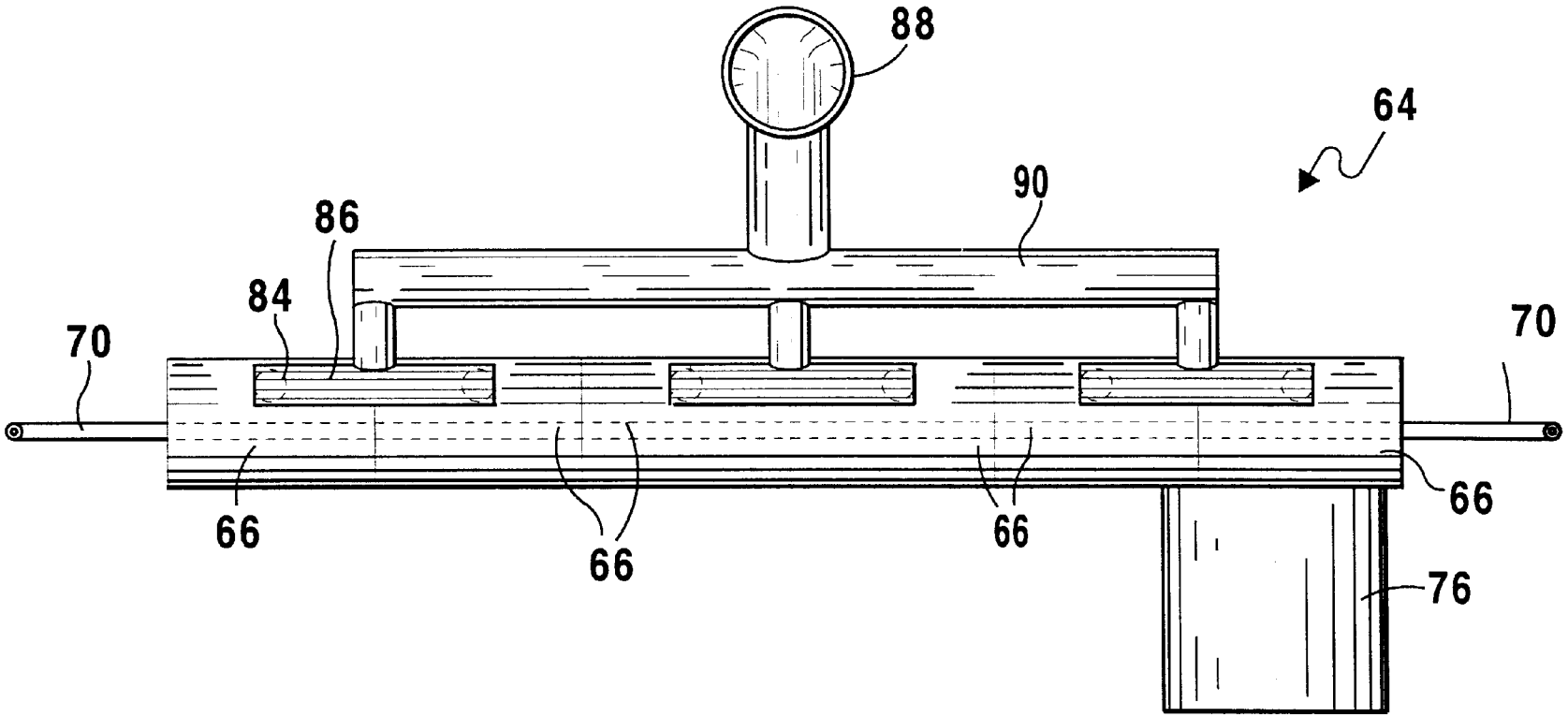
FIG. 8 is a rear elevational view of the dehydration unit within the food dehydration facility of the present invention showing the general configuration of the exhaust ducts from each chamber.

Illustrated in FIGS. 5–13 is a first embodiment of a dehydration unit 64. The dehydration unit 64 shown in these figures is an air injection dehydration unit and is positioned within the dehydration area 36. A perspective view of the air injection dehydration unit 64 is illustrated in FIG. 5. A right side view of the air injection dehydration unit 64 is shown in FIG. 7 and a left side view of the air injection dehydration unit 64 is shown in FIG. 8. The dehydration unit 64 includes a plurality of chambers 66 in alignment to form a cylinder 68. Extending through the cylinder 68 is a conveyor belt 70 for carrying food products to be dehydrated through the chambers 66. The chambers 66 at the end of the cylinder 68 include a recess 72 extending through an end wall 74 thereof allowing the conveyor belt 70 to pass therethrough. An air injection system including an air compressor 76 is connected to the cylinder 68 through a conduit 78 which branches off into a series of injector inlet channels 80. Each of the injector inlet channels 80 includes a valve 82 for regulating the amount and pressure of the air entering the chambers 66. The injector inlet channels 80 are connected to provide air to the chambers 66 forming the cylinder 68. The air compressor 76 draws air in from the environment surrounding the cylinder 68 or directly from the decontamination unit 46.

An exhaust duct 84 is connected to each chamber 66 for removing used air from the chambers 66. A preferred embodiment for exhausting used air from within the cylinder 68 is illustrated in the figures. The exhaust duct 84 extending from adjacent chambers 66 are connected together by first connection pipes 86. The first connection pipes 86 are connected to a main exhaust pipe 88 via a second exhaust duct 90. The main exhaust duct 88 releases the used air into the dehydration area wherein it is removed through the ventilation duct 18.

FIG. 6 illustrates a right side view of the air injection dehydration duct 64. The conveyor belt 70 is illustrated in this figure passing through the plurality of chambers 66 forming the cylinder 68. A plurality of injector inlet channels 80 are connected to each chamber 66 for providing air to the chambers 66. Each injector inlet channel 80 also includes a valve 82 for regulating the pressure and amount of air flowing therethrough and into the chambers 66.

Figure 9:
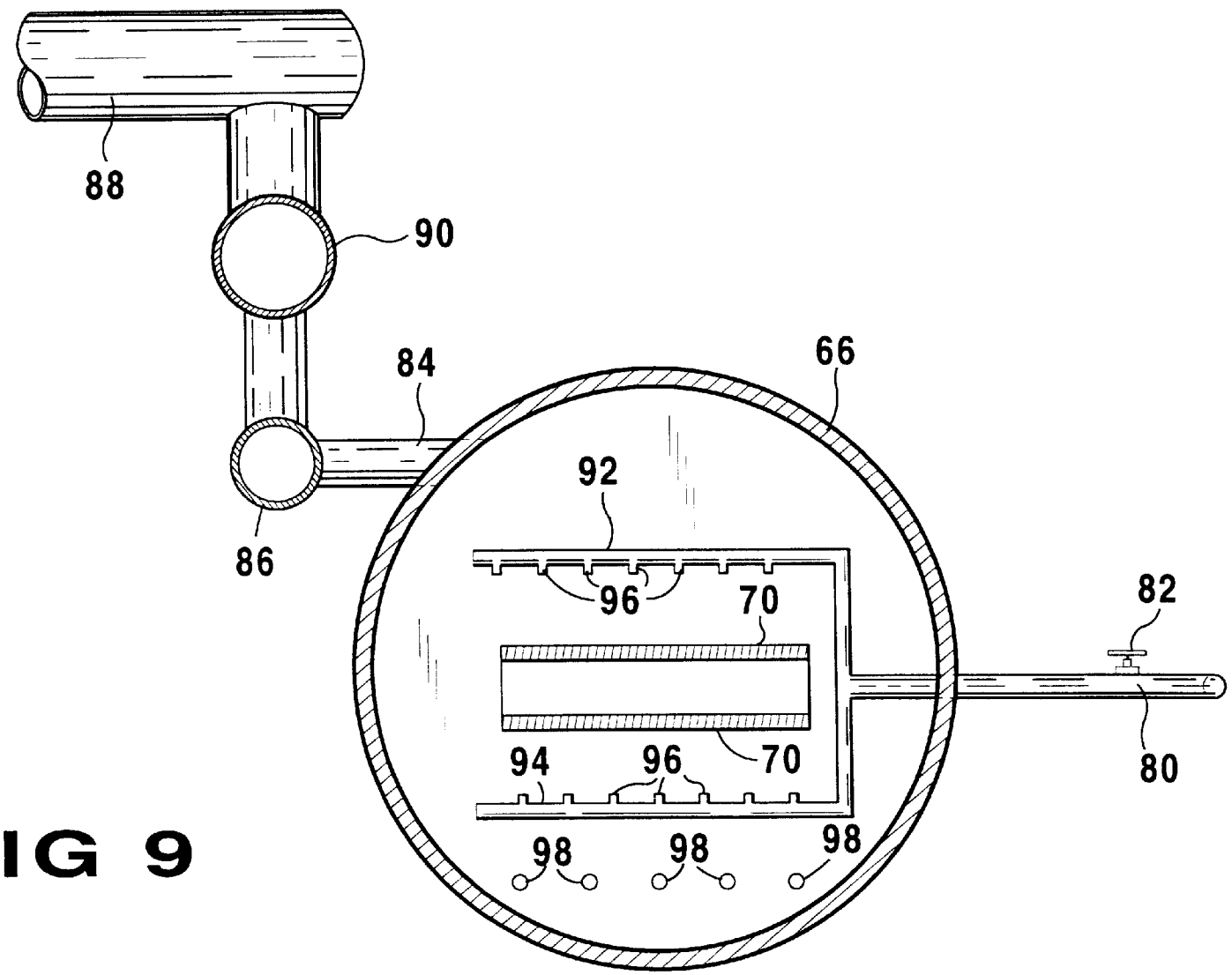
FIG. 9 is a cross-sectional view of one drying chamber of the dehydration unit within the food dehydration facility of the present invention illustrating one of a number of air intake pipes, each air intake pipe having a valve and leading into the drying chamber wherein it is split.

A cross-sectional view of the air injection dehydration duct 64 is shown in FIG. 9. As can be seen from this view, upon entering a respective one of the chambers 66, the injector inlet channel 80 splits to form a first arm 92 extending above the conveyor belt 70 passing through the chamber 66 and a second arm 94 passing below the conveyor belt 70. The first and second arms 92 and 94 each include a plurality of air injectors 96. The air injectors 96 direct a flow of air towards the conveyor belt 70 and thus towards any food products traveling on the conveyor belt 70. A plurality of heating elements 98 are also provided within each of the plurality of chambers 66 for heating the inside of the chambers 66 and any air delivered to the chambers 66 through the air injectors 96. The heating elements 98 heat the air delivered to the chambers 66 to a desired temperature for dehydrating the food products passing through the chambers 66 on the conveyor belt 70. A thermostat may be provided for regulating the temperature of the heating elements 98 and thus the air provided through the air injectors 96 to an optimal temperature for dehydration of the food products. The first air exhaust duct 84 is shown extending from the chambers 66 for removing air therefrom. As explained previously the air is removed through the series of ducts and deposited into the dehydration area 36. The air is then removed from the dehydration area 36 through the ventilation duct 18.

Figure 10:
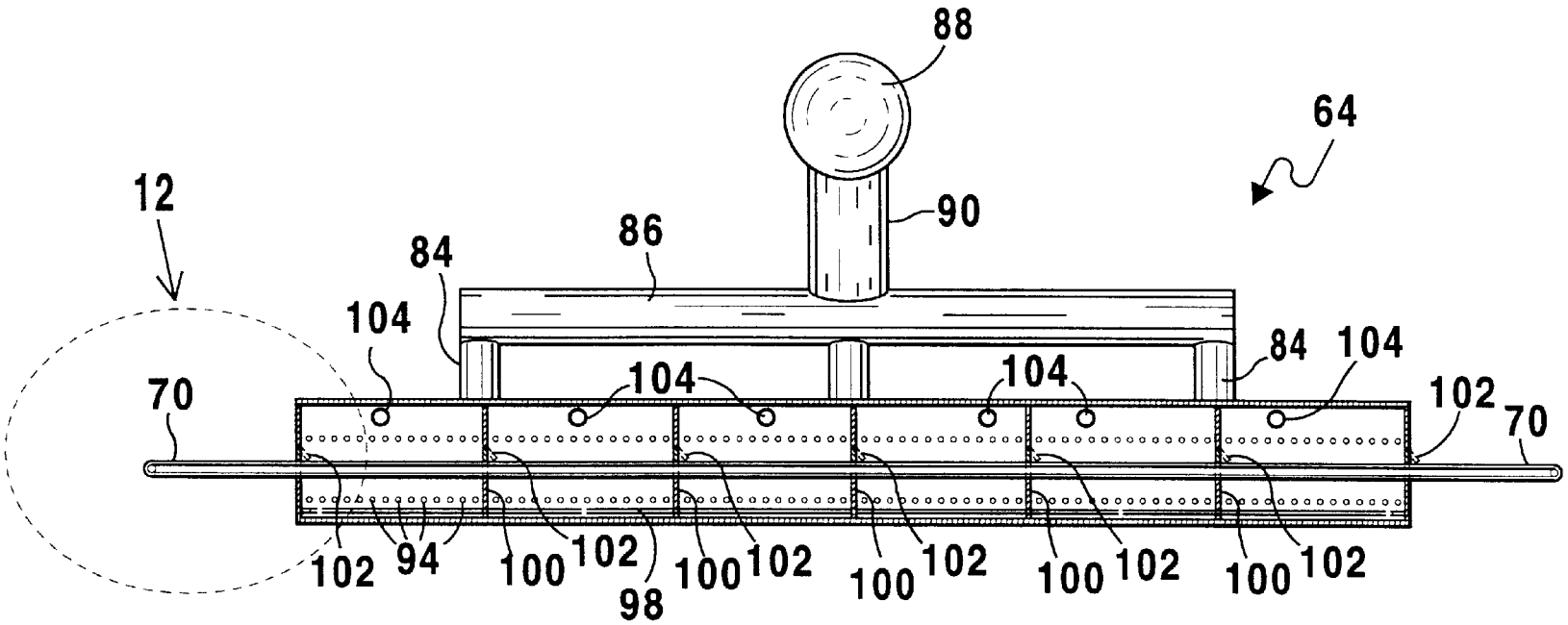
FIG. 10 is a front cross-sectional view of the dehydration unit within the food dehydration facility of the present invention taken along the line 10—10 of FIG. 7.
Figure 11:
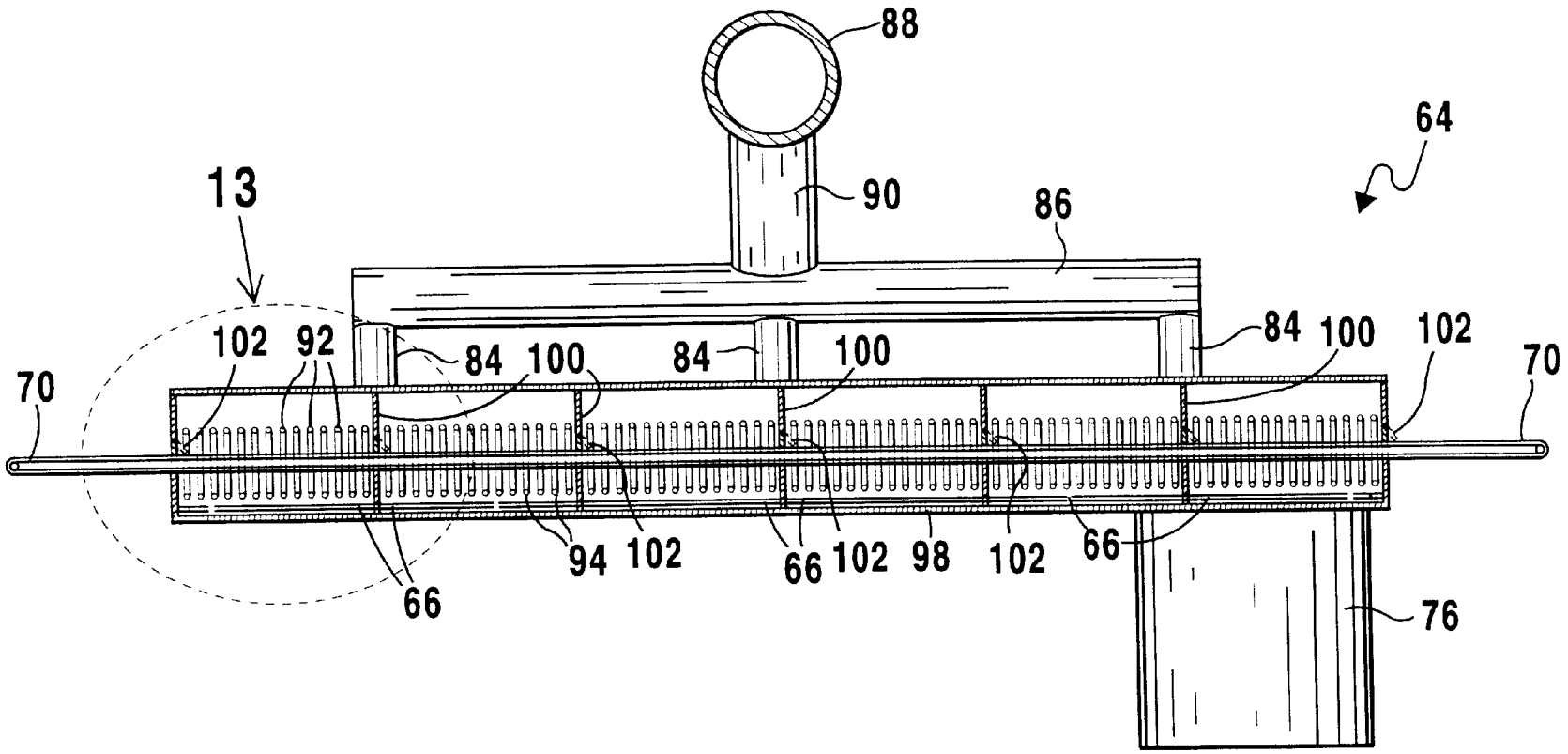
FIG. 11 is a rear cross-sectional view of the dehydration unit within the food dehydration facility of the present invention taken along the line 11—11 of FIG. 7.
Figure 12:
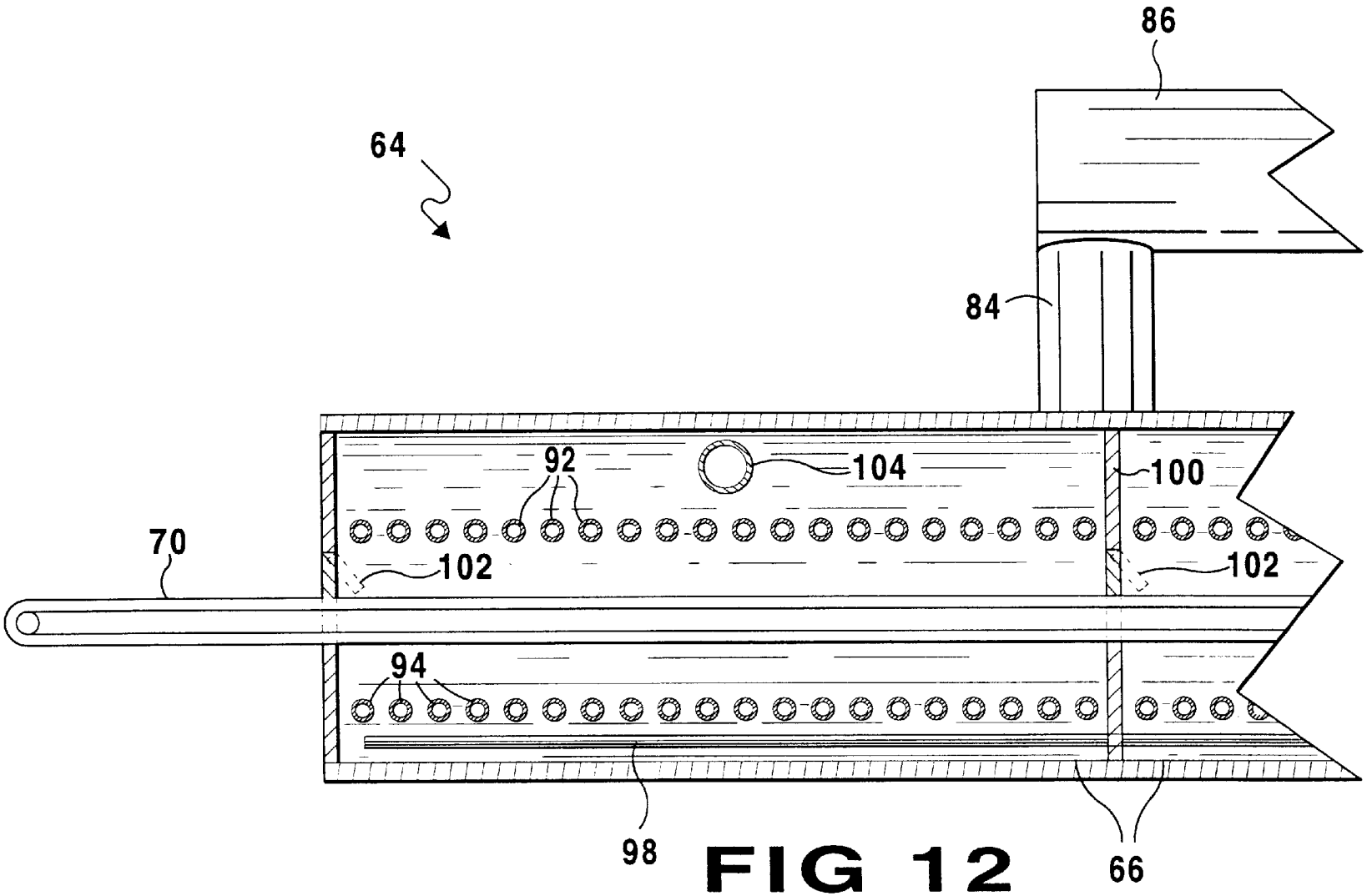
FIG. 12 is an enlarged view of one of the chambers of the dehydration unit within the food dehydration facility of the present invention taken from within the circle labeled 12 of FIG. 10.
Figure 13:
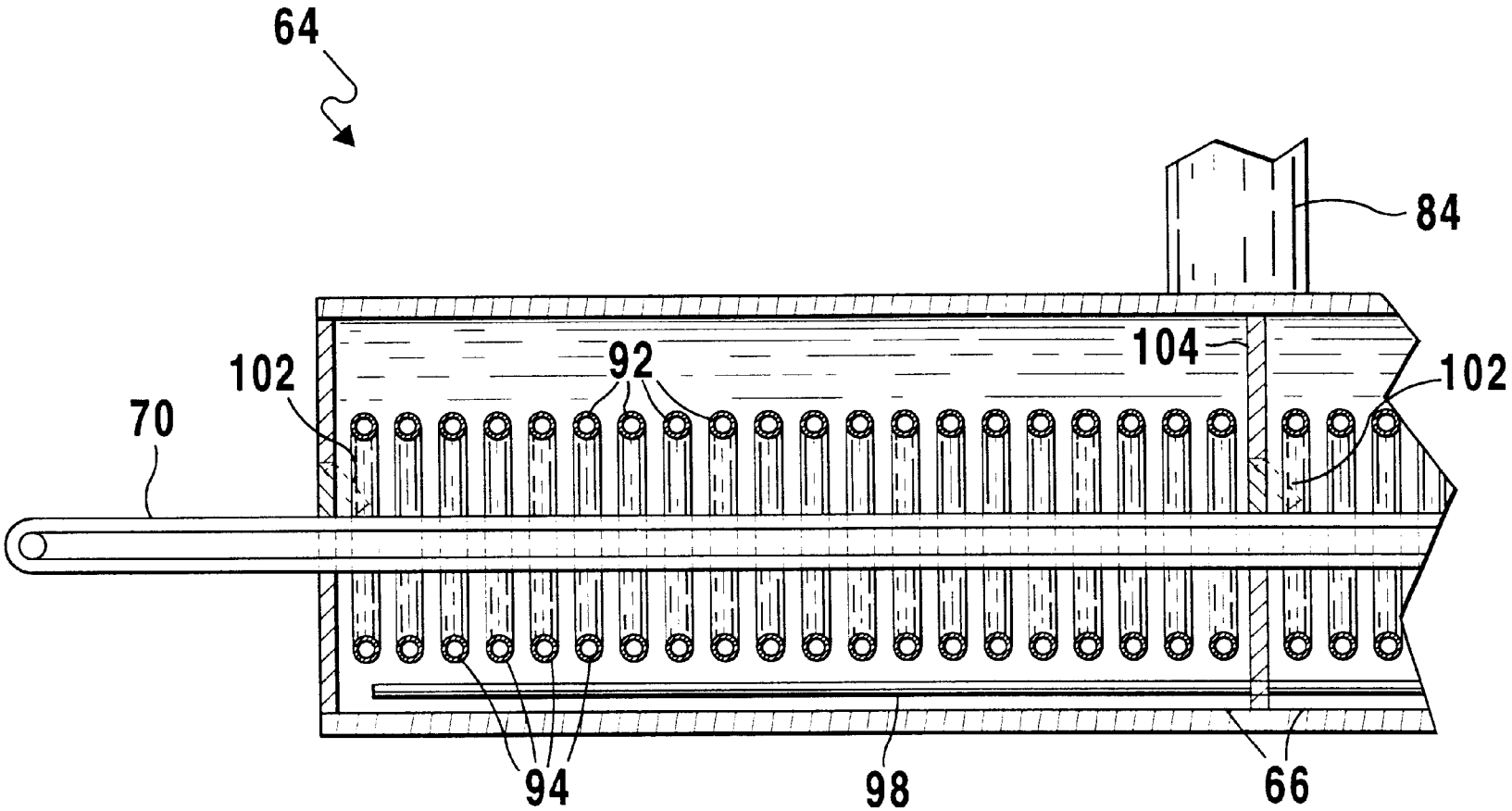
FIG. 13 is an enlarged view of one chamber of the dehydration unit within the food dehydration facility of the present invention taken from within the circle labeled 13 of FIG. 11.

A cross-sectional view taken along the line 10—10 of FIG. 7 and looking from the right side of the air injection dehydration duct 64 is illustrated in FIG. 10. A cross-sectional view taken along the line 11—11 of FIG. 7 and looking from the left side of the air injection dehydration duct 64 is illustrated in FIG. 11. As can be seen from FIGS. 10 and 11, each chamber 66 is separated by a wall 100. Each wall 100 includes a pivoting door 102 through which the conveyor belt 70 extends. Extending on either side of the conveyor belt 70 are the first and second arms 92 and 94 of the injector inlet channels 80. A recess 106 is also provided within each chamber 66 for connection to a respective one of the plurality of first exhaust ducts 84 providing a passageway for air to be removed from the chambers 66. An enlarged view of a single chamber is shown in FIGS. 12 and 13. The chamber shown in FIG. 12 is taken from within the circle labeled 12 of FIG. 10. The chamber shown in FIG. 13 is taken from within the circle labeled 13 of FIG. 11.

Figure 14:
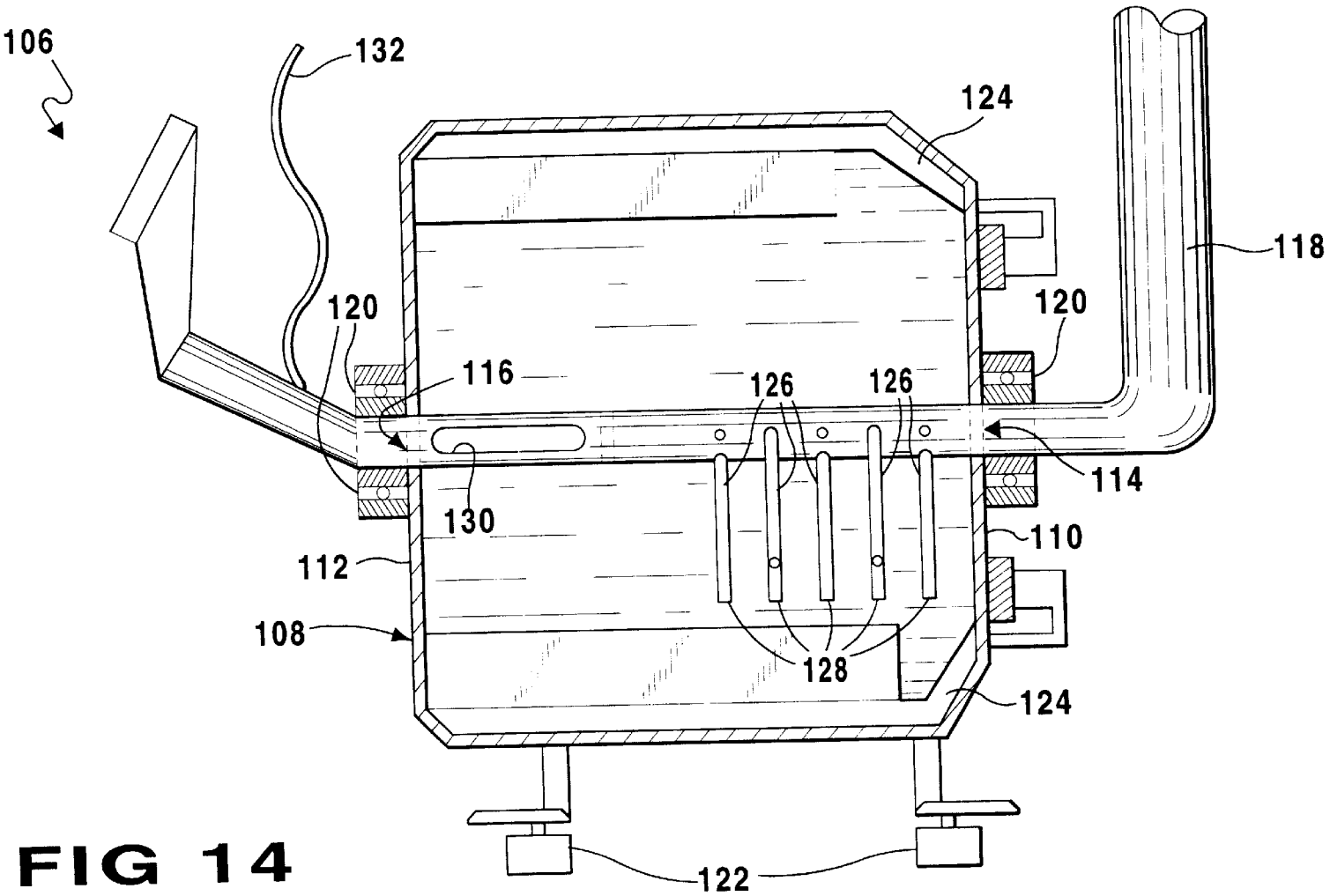
FIG. 14 is a perspective view of a rotary dehydration unit within the food dehydration facility of the present invention.
Figure 15:
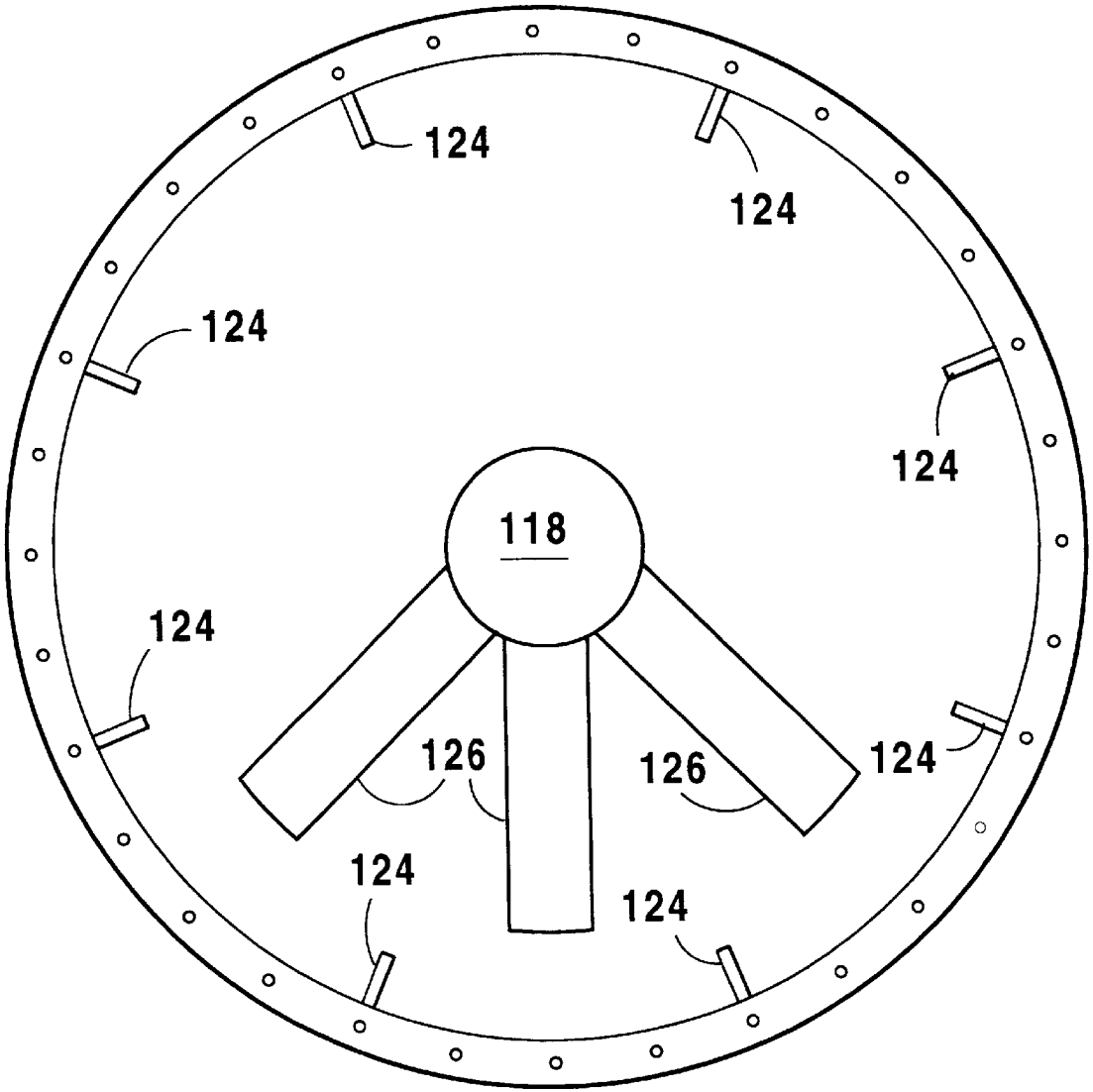
FIG. 15 is a cross-sectional view of the rotary dehydration unit within the food dehydration facility of the present invention.
Figure 16:
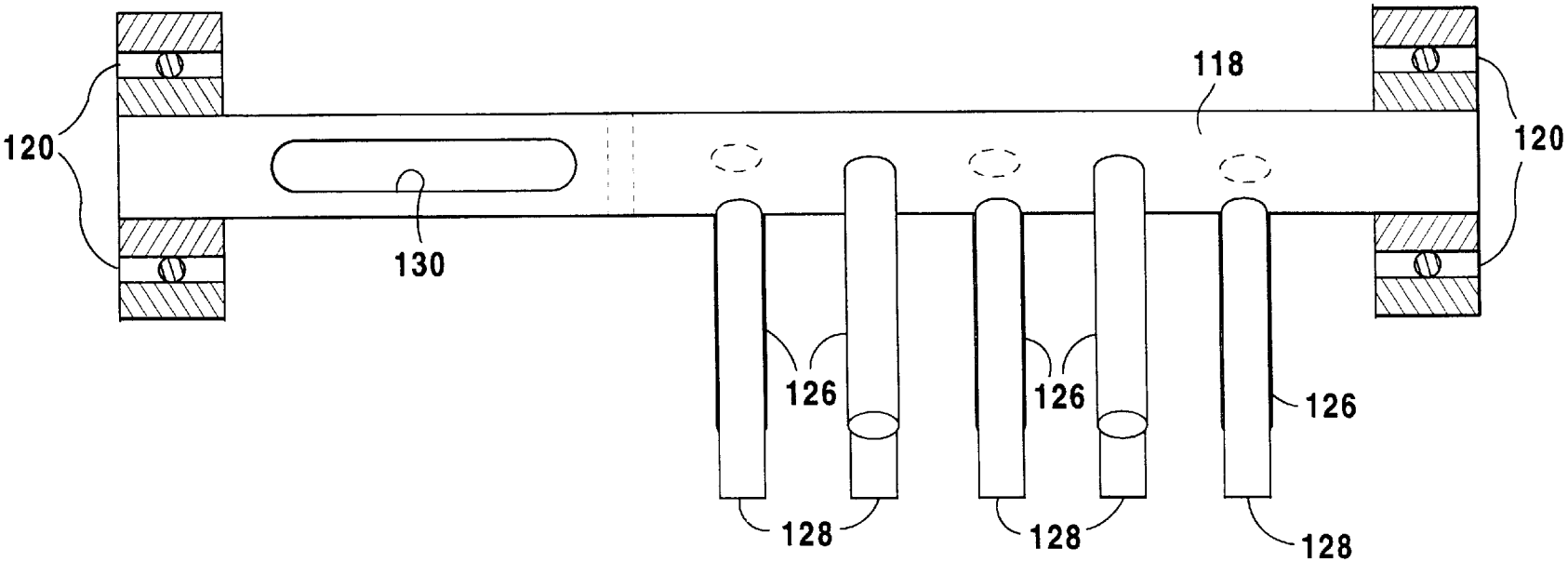
FIG. 16 is a side view of the rotary dehydration unit within the food dehydration facility of the present invention.

A second embodiment of the dehydration chamber 106 is illustrated in FIGS. 14–16. A cross-sectional view of the dehydration chamber 106 is shown in FIG. 14. The dehydration chamber 106 includes a cylindrical chamber 108 including a front wall 110 and a back wall 112. A first recess 114 is provided in the front wall 110 and a second recess 116 is provided in the back wall 112 through which an air inlet pipe 118 extends. A pair of bearings 120 are provided on both the front wall 110 and the back wall 112 for connecting the cylindrical chamber 108 to the air inlet pipe 118. The bearings 120 allow the cylindrical chamber 108 to rotate about the air inlet pipe 118. A rotary driver motor and guide 122 are connected to rotate the cylindrical chamber 108. Heating elements 124 are also provided within the cylindrical chamber 108 for heating the air provided to the chamber 108 through the air pipe 118.

Extending from the air pipe 118 are a plurality of mixing arms 126 as can be clearly seen in FIGS. 15 and 16. Each mixing arm 126 includes an open end 128 for providing air therethrough leading into the cylindrical chamber 108. Air is thus provided to the inside of the cylindrical chamber 108 through the open end 128 of each mixing arm 126. The mixing arms 126 are provided in groups, the groups preferably extending along a portion of the length of the air inlet pipe 118. Each group preferably includes one mixing arm extending vertically from the air inlet pipe 118 towards a base of the cylindrical chamber 108 and one mixing arm on either side thereof extending at an angle of from 45°–60° from the vertically extending arm as can be clearly seen in FIG. 15. Positioned on the air intake pipe 118 and between the groups of mixing arms 126 and the back wall 112 of the cylindrical chamber 108 is an inlet 130 for the air exhaust pipe 84. The air inlet pipe 118 extends out through the recess 116 in the back wall 112 and includes an air outlet 132 for air remaining in the air inlet pipe.

The operation of the food dehydration facility 10 will now be described with reference to the figures. In operation, food to be dehydrated by the food dehydration facility 10 is placed within the facility 10 on either the conveyor belt 70 or in the cylindrical chamber 108. When the facility 10 is placed in operation wind blowing outside of the facility will be received within the air intake funnel 26 of the air intake port 22. The air intake funnel 26 is able to rotate to receive a maximum amount of air by the rotational joint 30 and is powered to rotate by the wind vane 28. The wind vane 28 extends from the air intake port 22 in a direction opposite the air intake funnel 26 and as air blows and applies a force against the wind vane 28, the air intake port 22 is caused to rotate so that the air intake funnel 26 faces into the wind and is able to receive a maximum amount of air therein. A wind propelled air intake fan 25 aids the air intake funnel 26 in drawing air into the air intake funnel 26. The air received by the air intake funnel 26 is drawn down the air conduit 24 by an air entraining fan 27 and provided to the inside of the facility.

Upon entering the facility 10, the air is provided to a decontamination chamber 46 within the dehydration area 36 of the facility 10. The decontamination chamber 46 includes a solid air filter 48 at its input for removing large particles from the air and upon passing through the air filter 48 the air is passed through a shower of decontamination material. The shower will cause any particles in the air to fall into a pool 58 of contaminated water 56 and thus be removed from the air. The air will now pass through an outlet 60 of the decontamination chamber 46 and into the dehydration area 36.

Upon entering the dehydration area the air will be provided to the plurality of air injectors 80 and to the chambers of the dehydration unit 64. The pressure and amount of air supplied is regulated by a valve 82 connected to each of the air injectors. Within the chambers the air injectors divide into two arms, one arm extending on either side of the conveyor belt 70 passing therethrough. The air is directed through air injectors on each arm to the chambers 66 and fill the chambers 66. Also provided within the chambers 66 are heating elements 98 which heat the air to a desired or optimal temperature for dehydrating the food products traveling with the conveyor belt 70 through the chambers 66. The temperature of the air may be regulated by controlling the heating elements with a thermostat. The thermostat will maintain the heating elements 98 at a desired temperature and thus also maintain the air temperature at an optimal temperature for dehydrating the food products.

Alternatively, the rotational dehydration chamber 106 may be provided within the dehydration area 36. The dehydration chamber 106 includes a cylindrical chamber 108 which is connected to rotate about the air intake pipe 118 on a pair of bearings 120. A rotational motor is connected to provide a rotational drive force to rotate the chamber 108. The food to be dehydrated is placed within the cylindrical chamber 108 and caused to rotate with the chamber 108. Air is received by the dehydration chamber 106 through the air inlet pipe 118. The air inlet pipe 118 includes a plurality of mixing arms 126 having open ends for providing the air to the inside of the chamber 108. Heating elements 124 are also provided within the chamber for heating the air delivered through the mixing arms. The air is heated by the heating elements 124 to an optimal temperature for dehydrating the food products placed therein. The temperature of the heating elements 124 and thus the temperature to which the air is heated may be controlled by a thermostat. As the chamber rotates the food products also rotate and are dehydrated by the heated air. The heated air is removed from within the chamber 108 via an air inlet 130 leading to exhaust ducts and an air outlet pipe 132.

The air removed from the chamber 64 or 108 are then removed from the dehydration area through a ventilation duct 18. Once dehydrated the food products can be removed from the chamber 108 or taken off of the conveyor belt 70 and stored in the storage area 38 of the facility 10. Alternatively, the food products may be eaten or at a later time may be reconstituted by simply placing the food products in water.

From the above description it can be seen that the food dehydration facility of the present invention is able to overcome the shortcomings of prior art devices by providing a food dehydration facility which is able to dehydrate food using specific combinations of air and heat whereby the food will maintain its nutritional value while also maintaining the original color of the food without the use of artificial colorings. The food dehydration facility is also able to dehydrate food to produce a dehydrated food product that may be readily reconstituted in a safe, effective manner wherein large quantities of foodstuffs may be treated in a relatively short period of time. Furthermore, the food dehydration facility of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An atmospheric conditioning system comprising:

a) a facility having an interior portion to house purified air and an exterior portion;

b) an air intake system for supplying a flow of air to said interior of said facility;

c) an air purification chamber comprising an air inlet functionally connected to said air intake assembly, means for purifying said air flow as it passes through said chamber, and an air outlet;

d) an air exhaust port having means for directing air flow out of said interior of said facility;

e) said air purifying means comprising a nozzle positioned on a top side of said purification chamber for spraying a purifying substance in a constant curtain across said chamber in a direction transverse to the flow of air through said chamber thereby removing contaminants from the air flowing below said nozzle and through said chamber; and f) said purification chamber further including a decontamination tank positioned below said nozzle for receiving said purifying substance sprayed by said nozzle, means for decontaminating said purifying substance, and means for returning said purifying substance back to said nozzle from said decontamination tank after decontamination by said decontamination means.

2. The atmospheric conditioning system as defined in claim 1, wherein said purifying substance is one of a gas and liquid.

3. The atmospheric conditioning system as defined in claim 2, wherein said liquid is water.

4. The air purification system as defined in claim 1, wherein said liquid decontamination means at least one of ozone and ultraviolet light.

5. The atmospheric conditioning system as defined in claim 1, wherein said returning means includes a conduit between said decontamination tank and said nozzle; and a pump for pumping said decontaminated purifying substance through said conduit.

6. The atmospheric conditioning system as defined in claim 5, wherein said purification filter further includes a filter positioned to cover said air inlet.

7. The atmospheric conditioning system as defined in claim 6, wherein said filter is at least one of a cartridge filter, a sand filter and a diatomaceous earth filter.

8. An air-injected dehydration apparatus for dehydrating a food product, said apparatus comprising:

a) a dehydration chamber including:

i) means for setting and maintaining a specific temperature within said dehydration chamber;

ii) means for moving the food product within said chamber; and iii) means for dispersing air provided to said chamber;

b) an air injection system for providing air to said means for dispersing;

c) means for exhausting air from said chamber; and d) said air injection system comprising an air compressor for supplying pressurized air to said chamber, a source of air to be pressurized by said compressor, and a pressure conduit to channel said pressurized air from said compressor to said means for dispersing air.

9. The air injected dehydration unit as defined in claim 8, wherein said chamber is substantially cylindrically shaped and includes an entry at a first end and an exit at a second end thereof for passage of food products therethrough.

10. The air injected dehydration unit as defined in claim 9, wherein said chamber includes a plurality of said compartments connected together, adjacent compartments being separated by a dividing wall including a recess extending therethrough for passage of food products.

11. The air injected dehydration unit as defined in claim 10, further comprising a pivotable door hinged to said entrance, said exit and said recesses in said dividing walls allowing food products to pass therethrough while maintaining each compartment environmentally isolated from one another.

12. The air injected dehydration unit as defined in claim 9, wherein said means for moving is a conveyor belt extending on either side of said entrance and exit of said chamber.

13. The air injected dehydration unit as defined in claim 12, wherein said conveyor belt is driven by a variable speed motor permitting an operator to move the material through said chambers at a specific rate.

14. The air injected dehydration unit as defined in claim 8, wherein said setting and maintaining means is a heating element regulated by a thermostat.

15. The air injected dehydration unit as defined in claim 14, wherein said setting and maintaining means includes a plurality of heating elements contained within said chamber, said thermostat controlling all of said plurality of heating elements.

16. A system for dehydrating food products, said system comprising:

a) a facility having an interior portion to house purified air and an exterior portion;

b) an air intake system for supplying a flow of air from said exterior to said interior of said facility;

c) an air purification chamber comprising an air inlet functionally connected to said air intake assembly, means for purifying said air flow as it passes through said chamber, and an air outlet;

d) an air injection system for receiving air from said air purification chamber;

e) a dehydration chamber including:

i) means for setting and maintaining a specific temperature within said dehydration chamber;

ii) means for moving the food product within said chamber; and iii) means for receiving air from said air injection system and dispersing the air within said chamber; and f) means for exhausting air from said chamber.

17. An atmospheric conditioning system comprising:

a) a facility having an interior portion to house purified air and an exterior portion;

b) an air intake system for supplying a flow of air to said interior of said facility;

c) an air purification chamber comprising an air inlet functionally connected to said air intake assembly, means for purifying said air flow as it passes through said chamber, and an air outlet;

d) an air exhaust port having means for directing air flow out of said interior of said facility; and e) said air intake system including means for directing air from outside said facility to said air purification chamber.

18. The atmospheric conditioning system as defined in claim 17, wherein said air intake system comprises at least one air intake assembly, said air intake assembly comprising:

a) an air intake funnel;

b) an air conduit connected between said air intake funnel and said air purification chamber for delivering air received by said air intake funnel to said air purification chamber.

19. The atmospheric conditioning system as defined in claim 18, further comprising means for rotatively coupling said air intake funnel to said conduit.

20. The atmospheric conditioning system as defined in claim 19, wherein said coupling means includes a stationary end connected to said conduit and a rotatable end connected to said air intake funnel rotatably joined together by a rotatable ball-bearing-type flange.

21. The atmospheric conditioning system as defined in claim 20, wherein said air intake funnel further includes a wind vane extending from a back side of said air intake funnel and facing in a direction opposite said air intake funnel, said wind vane including a vertical plate having a size sufficient to rotate said air intake funnel to face in a direction to receive a maximum amount of wind when a force is applied thereto by blowing wind.

22. The atmospheric conditioning system as defined in claim 21, wherein said air intake funnel spins on a 360 degree rotational axis.

23. The atmospheric conditioning system as defined in claim 18, further comprising a free-wheeling fan is located within said central conduit of said air intake funnel.

24. The atmospheric conditioning system as defined in claim 18, wherein said air intake assembly further includes an electric fan positioned within said conduit for pulling air from the exterior of said facility to said interior of said facility.

25. An air-injected dehydration apparatus for dehydrating a food product, said apparatus comprising:

a) a dehydration chamber including:

i) means for setting and maintaining a specific temperature within said dehydration chamber;

ii) means for moving the food product within said chamber; and iii) means for dispersing air provided to said chamber;

b) an air injection system for providing air to said means for dispersing;

c) means for exhausting air from said chamber;

d) said chamber including a plurality of compartments and said pressure conduit runs longitudinally along said plurality of compartments and includes a plurality of divergent injector inlet channels providing passageway for said pressurized air into said plurality of compartments, each injector inlet including a valve for individually adjusting a pressure of air flowing therethrough.

26. An air-injected dehydration apparatus for dehydrating a food product, said apparatus comprising:

a) a dehydration chamber including:

i) means for setting and maintaining a specific temperature within said dehydration chamber;

ii) means for moving the food product within said chamber; and iii) means for dispersing air provided to said chamber;

b) an air injection system for providing air to said means for dispersing;

c) means for exhausting air from said chamber; and d) said means for dispersing passes through a side of said chamber and includes an upper injection arm and a lower injection arm, said upper and lower injection arms extending on either side of said means for moving.

27. The air injected dehydration unit as defined in claim 26, further comprising a plurality of air injectors on said upper and lower injector arms.

28. An air-injected dehydration apparatus for dehydrating a food product, said apparatus comprising:

a) a dehydration chamber including:

i) means for setting and maintaining a specific temperature within said dehydration chamber;

ii) means for moving the food product within said chamber; and iii) means for dispersing air provided to said chamber;

b) an air injection system for providing air to said means for dispersing;

c) means for exhausting air from said chamber; and d) said chamber being rotatable about said air injection system and food products are positioned in and rotatable with said chamber.

29. The air injected dehydration unit as claimed in claim 28, wherein said air injection system extends through said chamber, said chamber and air injection system being connected together by first and second pairs of bearings positioned on either side of said chamber.

30. The air injected dehydration unit as claimed in claim 29, wherein said air injection system includes a plurality of mixing arms extending within said chamber for providing air to an inside of said chamber, said mixing arms remaining stationary within said chamber.

31. The air injected dehydration unit as claimed in claim 30, wherein said means for setting and maintaining includes a plurality of heating elements extending through a length of said chamber.

a) an air intake system for supplying a flow of air to said interior of said facility;

b) an air purification chamber comprising an air inlet functionally connected to said air intake assembly, means for purifying said air flow as it passes through said chamber, and an air outlet; and c) an air exhaust port having means for directing air flow out of said interior of said facility.

* * * * *